US012276056B2

(12) United States Patent
Tsuchiya et al.

(10) Patent No.: US 12,276,056 B2
(45) Date of Patent: Apr. 15, 2025

(54) COORDINATE DATA GENERATOR, SEWING MACHINE, AND PROGRAM

(71) Applicant: JANOME Corporation, Tokyo (JP)

(72) Inventors: Minami Tsuchiya, Tokyo (JP); Hiromi Oda, Tokyo (JP)

(73) Assignee: JANOME Corporation, Tokyo (JP)

( * ) Notice: Subject to any disclaimer, the term of this patent is extended or adjusted under 35 U.S.C. 154(b) by 0 days.

(21) Appl. No.: 18/383,691

(22) Filed: Oct. 25, 2023

(65) Prior Publication Data

US 2024/0076817 A1 Mar. 7, 2024

Related U.S. Application Data

(63) Continuation of application No. PCT/JP2022/010762, filed on Mar. 11, 2022.

(30) Foreign Application Priority Data

Apr. 28, 2021 (JP) ..... 2021-076661

(51) Int. Cl.
*D05B 19/08* (2006.01)

(52) U.S. Cl.
CPC ..... *D05B 19/08* (2013.01)

(58) Field of Classification Search
CPC ..... D05B 19/02; D05B 19/04; D05B 19/08; D05B 19/14; D05C 5/02
See application file for complete search history.

(56) References Cited

U.S. PATENT DOCUMENTS

2013/0190916 A1* 7/2013 Schnaufer ..... D05B 19/12 700/137
2020/0010990 A1* 1/2020 Kongo ..... D05B 19/08

FOREIGN PATENT DOCUMENTS

JP H4-79982 A 3/1992
JP 2011-245092 A 12/2011
JP 2020-005797 A 1/2020

OTHER PUBLICATIONS

International Search Report issued in PCT/JP2022/010762 mailed on Jun. 7, 2022 with English Translation (5 pages).
Written Opinion of International Searching Authority issued in PCT/JP2022/010762 mailed on Jun. 7, 2022 with English Translation (5 pages).

* cited by examiner

*Primary Examiner* — Nathan E Durham
(74) *Attorney, Agent, or Firm* — Nakanishi IP Associates, LLC

(57) ABSTRACT

A coordinate data generator comprises a coordinate data storage to store a coordinate data of needle positions; and a post-addition coordinate data generation section to add independent values to a X coordinate value or a Y coordinate value of the coordinate data for each item of the coordinate data stored in the coordinate data storage, so as to generate new coordinate data.

5 Claims, 9 Drawing Sheets

| | ORIGINAL DATA | | | RANDOM NUMBER ADJUSTMENT LENGTHS | | HAND-DRAWN PROCESSING | | |
|---|---|---|---|---|---|---|---|---|
| STITCH NUMBER | AMPLITUDE | RELATIVE FEED | ABSOLUTE FEED | FOR AMPLITUDE | FOR FEED | AMPLITUDE | ABSOLUTE FEED | RELATIVE FEED |
| 21 | −2.6 | 0.5 | 10.2 | −0.8 | 0.5 | −3.4 | 10.7 | −0.4 |
| 22 | 0.0 | −0.7 | 10.7 | −0.6 | −0.4 | −0.6 | 10.3 | 0.2 |
| 23 | −2.6 | −0.7 | 10.0 | −0.8 | 0.5 | −3.4 | 10.5 | −2.5 |
| 24 | −3.8 | −2.2 | 7.8 | −0.4 | 0.2 | −4.2 | 8.0 | 2.7 |
| 25 | −2.6 | 2.4 | 10.2 | −0.8 | 0.5 | −3.4 | 10.7 | −2.7 |
| 26 | −4.0 | −2.2 | 8.0 | −0.4 | 0.2 | −4.4 | 8.0 | −3.3 |
| 27 | −4.0 | −3.0 | 5.0 | 1.0 | −0.3 | −3.0 | 4.7 | 3.3 |
| 28 | −3.8 | 2.8 | 7.8 | −0.4 | 0.2 | −4.2 | 8.0 | −3.3 |
| 29 | −3.8 | −3.0 | 4.8 | 1.0 | −0.3 | −2.8 | 4.7 | −2.2 |
| 30 | −2.6 | −2.0 | 2.8 | 0.0 | −0.3 | −2.6 | 2.5 | 2.2 |
| 31 | −4.0 | 2.2 | 5.0 | 1.0 | −0.3 | −3.0 | 4.7 | −2.4 |
| 32 | −2.6 | −2.3 | 2.7 | 0.0 | −0.3 | −2.6 | 2.4 | −0.6 |
| 33 | 0.0 | −1.0 | 1.7 | 0.6 | 0.0 | 0.6 | 1.7 | 0.8 |
| 34 | −2.6 | 1.1 | 2.8 | 0.0 | −0.3 | −2.6 | 2.5 | −0.7 |
| 35 | 0.0 | −1.0 | 1.8 | 0.6 | 0.0 | 0.6 | 1.8 | 0.0 |

FIG. 9

COORDINATE DATA GENERATOR, SEWING MACHINE, AND PROGRAM

CROSS-REFERENCE TO RELATED APPLICATIONS

This application is a continuation application of International Patent Application No. PCT/JP2022/010762 filed on Mar. 11, 2022, which claims priority to Japanese Patent Application No. 2021-076661 filed on Apr. 28, 2021, the entire contents of which are incorporated by reference.

TECHNICAL FIELD

The present invention relates to a coordinate data generator, a sewing machine, and a program.

BACKGROUND ART

Generally a seam on a sewing machine has a position determined by amplitude of needle positions and amounts of cloth feed.

Thus, patterns are created by joining needle positions together with thread.

The needle positions are based on the figure to be sewn, needle positions are determined for each stitch, and data input is performed.

Namely, fundamentally, sewing data are often produced so as to be able to accurately reproduce an original figure using seams.

This then enables the original figure to be drawn according to the sewing data using seams by connecting needle positions in straight lines and curves.

This means that anyone is able to accurately reproduce a pattern as long as they use a sewing machine, and anyone is able to form a beautiful pattern on a cloth that looks as if it has been sewn by a sewing expert.

However this has actually tended to give a mechanical and cold impression.

In order to address this issue, the patent literature 1 discloses a technique for producing stitches that give a hand-drawn-effect to the stitch pattern and a pleasant warm feeling by giving a moderate variation to each stitch.

In the technology described in the patent literature 1, even if the needle positions are in a different sewing order, the coordinate data has the same coordinates and the variation is the same, making it possible to transform the pattern in a hand-drawn style while maintaining the original shape.

PATENT LITERATURES

Patent Literature 1: Japanese Patent Application Laid-Open (JP-A) No. 2020-05797

SUMMARY OF INVENTION

Technical Problem

Depending on the pattern, including, for example, multiple rings or bold lines, the position may approximate a previously sewn needle position.

In this case, the technology described in the Patent Literature 1 made it possible for the variation to be the same for coordinate data that are the same coordinates, but for coordinate data that are not the same coordinates, it was difficult to maintain the original pattern form depending on the variation given.

In consideration of the above issues, an object of the present invention is to provide a coordinate data generator, a sewing machine, and a program that are able to create seams that deliver a hand-drawn-effect in a sewing pattern and give a warm fuzzy feeling without significantly damaging the shape of the original pattern by imparting an appropriate amount of variation to each stitch.

Solution to Problem

First Aspect:

One or more embodiments of the present invention provide a sewing machine coordinate data generator to generate coordinate data of absolute positions configured by X coordinate values and Y coordinate values of needle positions for a pattern to be sewn.

The coordinate data generator comprising: a coordinate data storage to store the coordinate data of the needle positions; and a post-addition coordinate data generation section to add respective independent values to the X coordinate value or the Y coordinate value of the coordinate data for each item of the coordinate data stored in the coordinate data storage, so as to generate new coordinate data.

The post-addition coordinate data generation section, when a distance (>0) between the coordinate data of a needle position of 1 and the coordinate data of the other needle position stored in the coordinate data storage section is less than a predetermined distance, makes the respective independent values to be added to the X coordinate value or the Y coordinate value of the coordinate data of the needle position of 1 the same values for the respective independent values to be added to the X coordinate value or the Y coordinate value of the coordinate data of the other needle position.

Second Aspect:

One or more embodiments of the present invention provide the coordinate data generator in which the post-addition coordinate data generation section makes the coordinate data of the needle position of 1 that is less than a predetermined distance (>0) and the coordinate data of the other needle position the same coordinate data.

Third Aspect:

One or more embodiments of the present invention provide the coordinate data generator comprising a setting unit that sets the predetermined distance.

Fourth Aspect:

One or more embodiments of the present invention provide a sewing machine comprising the coordinate data generator as described in any one of first aspect to third aspect.

Fifth Aspect:

One or more embodiments of the present invention provide a program to cause a computer to execute a coordinate data generation method that is performed in a sewing machine coordinate data generator including a coordinate data storage to store coordinate data and a post-addition coordinate data generation section, and that generates coordinate data of absolute positions configured by X coordinate values and Y coordinate values of needle positions for a pattern to be sewn.

When the distance between the coordinate data of the needle position of 1 stored in the coordinate data storage unit and the coordinate data of the other needle position is equal to or less than a predetermined distance, the post-addition coordinate data generation section causes the computer to perform processing of adding the respective independent values to the X coordinate value or the Y coordinate value of the coordinate data of the needle position of 1 to be identical with the respective independent values to the X coordinate value or the Y coordinate value of the coordinate data of the other needle position.

Advantageous Effects of Invention

One or more embodiments of the present invention exhibit the advantageous effect of being able to generate seams that deliver a hand-drawn-effect in a sewing pattern and give a warm fuzzy feeling without significantly damaging the shape of the original pattern by imparting an appropriate amount of variation to each stitch.

BRIEF DESCRIPTION OF DRAWINGS

FIG. 9 is a diagram illustrating an example of a table of needle positions for stitching according to an Example 1 of the present invention, in which needle positions are present at the approximate position.

DESCRIPTION OF EMBODIMENTS

Embodiments

Description follows regarding embodiment of the present invention, with reference to FIG. 1 to FIG. 9.

Electrical Configuration of Coordinate Data Generator-10

An electrical configuration of a coordinate data generator 10 according to this embodiment will be described, with reference to FIG. 1.

Figure 1:
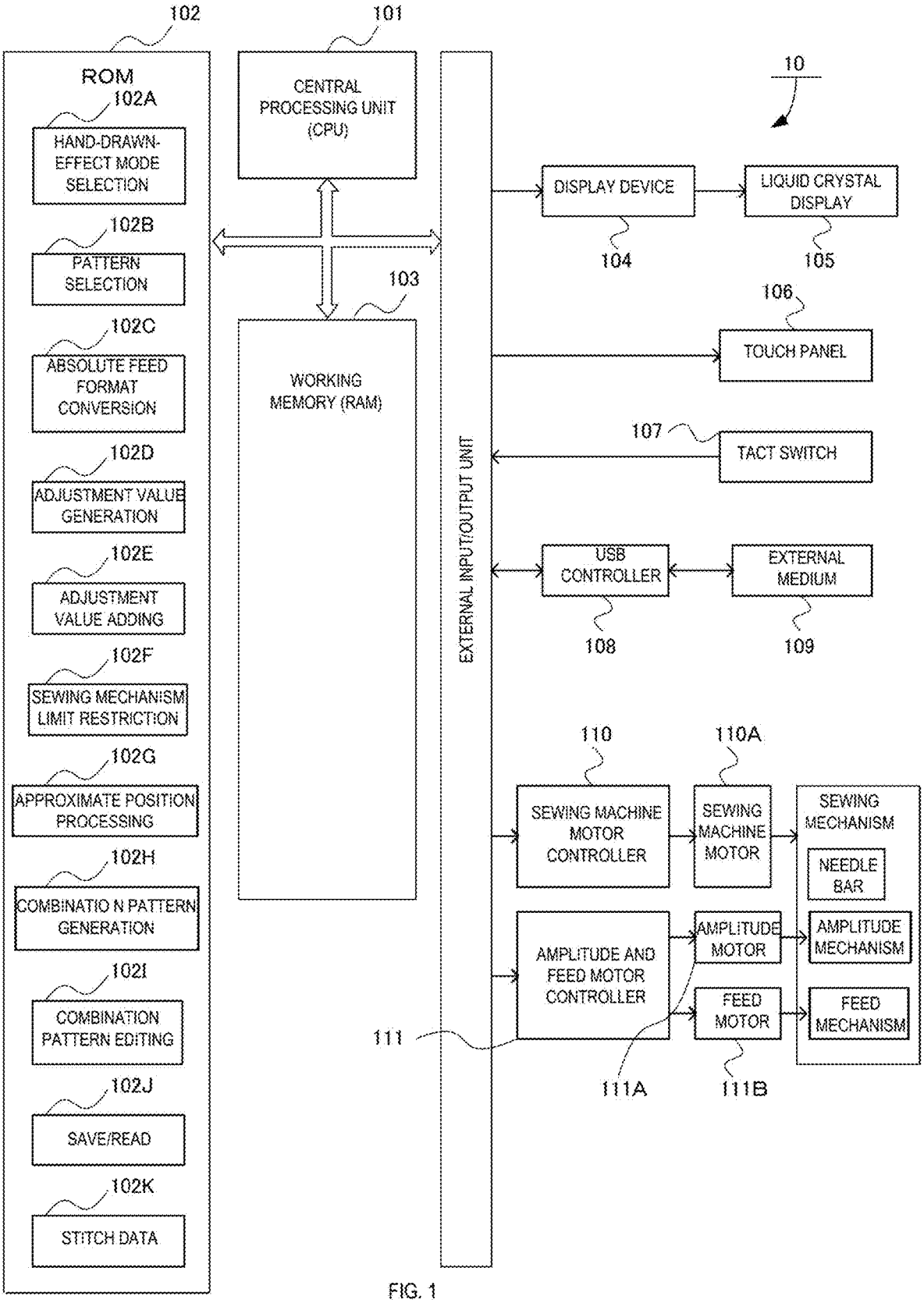
FIG. 1 is an electrical block diagram of a coordinate data generator according to an embodiment of the present invention.

As illustrated in FIG. 1, the coordinate data generator 10 according to this embodiment includes a central processing unit (CPU) 101, a ROM 102, a working memory (RAM) 103, a display controller 104, a liquid crystal display 105, a touch panel 106, a tact switch 107, a USB controller 108, an external medium 109, a sewing machine motor controller 110, an amplitude and feed motor controller 111, a sewing machine motor 110A, an amplitude motor 111A, and a feed motor 111B.

The central processing unit (CPU) 101 controls the overall operation of the coordinate data generator 10 according to a control program stored on the ROM 102.

The central processing unit (CPU) 101 is also connected to various devices through an external input/output unit.

ROM 102 mainly functions as a storage section for storing stitch data and functional modules in this embodiment.

RAM 103 mainly functions as a working memory that temporarily stores working data, etc. in this embodiment.

The ROM 102 stores data, and functional modules, such as a hand-drawn-effect mode selection module 102A, a pattern selection module 102B, an absolute feed format conversion module 102C, an adjustment value generation module 102D, an adjustment value adding module 102E, a sewing mechanism limit restriction module 102F, an approximate position processing module 102G, a combination pattern generation module 102H, a combination pattern edit module 102I, a save/read module 102J, store area for stitch data 102K, and the like.

Figure 3:
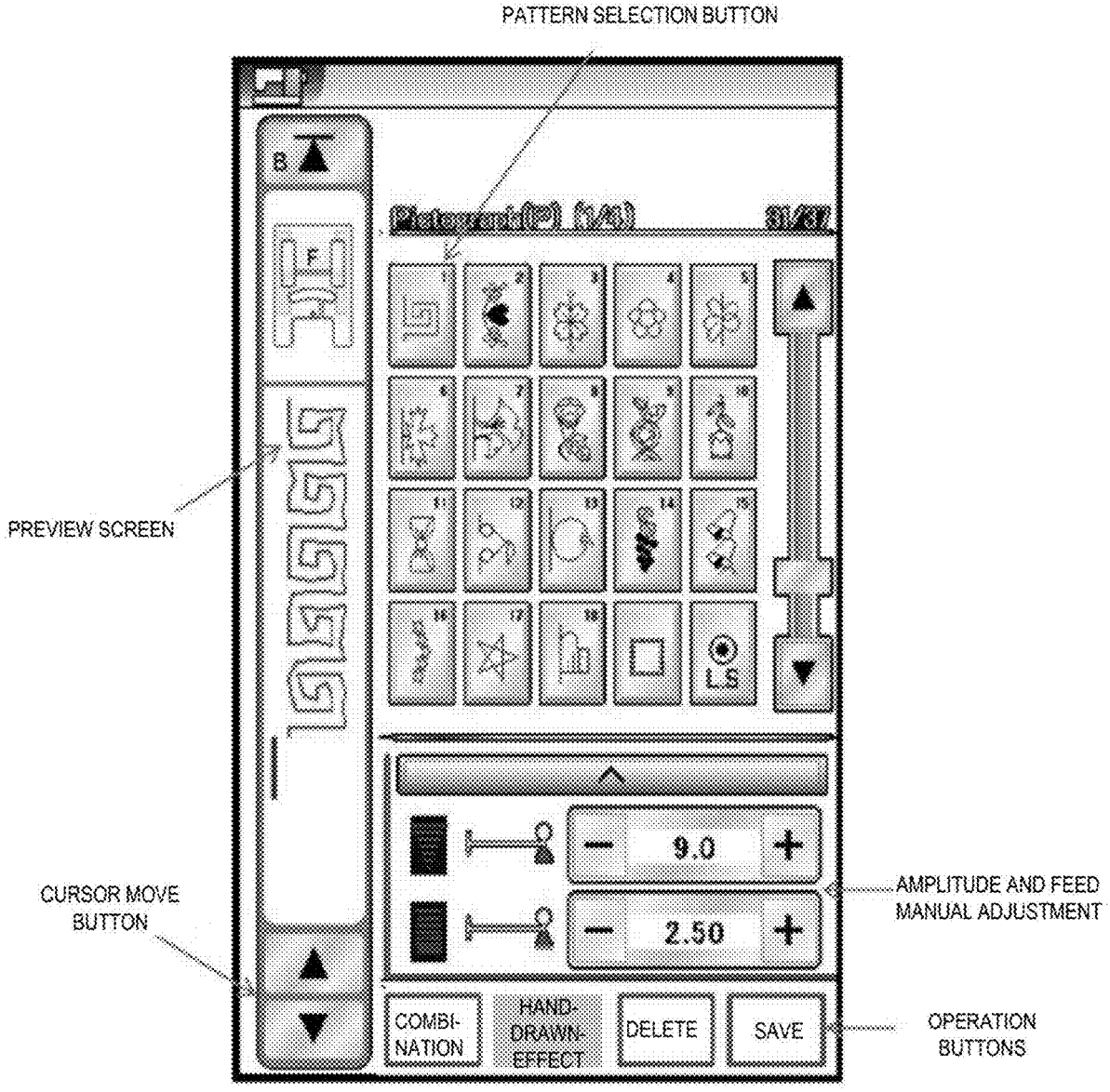
FIG. 3 is a diagram illustrating an example of an operational screen during screen operation in the coordinate data generator according to the embodiment of the present invention.

The hand-drawn-effect mode selection module 102A becomes active when the user presses the "hand-drawn-effect" button on the operation screen displayed on the liquid crystal display (LCD) 105 shown in FIG. 3, and fine-adjusts the stitch data 102K using the hand-drawn-effect stitch conversion function for the pattern selected thereafter.

The pattern selection module 102B reads the stitch data 102K for one pattern by selecting the pattern with pattern number 1 built in the ROM 102 of the sewing machine by the user pressing, for example, the number 1 button in the "pattern selection" buttons on the operation screen displayed on the LCD 105 shown in FIG. 3.

The absolute feed format conversion module 102C accumulates the feed volume of the relative feed stitch data 102K and converts it to an absolute coordinate data format.

The adjustment value generation module 102D converts the integer random number value generated when the pattern selection operation by the user is performed by the pattern selection module 102B into a unit of 0.1 mm. Then the adjustment value generation module 102D converts the random number value into a unit of length, and generates an adjustment value.

The adjustment value adding module 102E adds the adjustment value generated by the adjustment value generation module 102D to each of the original amplitude value and the absolute feed data.

The sewing mechanism limit restriction module 102F becomes active when the processing result of the adjustment value adding module 102E exceeds the limit value of the amplitude and feed mechanism, and limits the execution of the processing result by the adjustment value adding module 102E.

The approximate position processing module 102G operates when there is the other original data within the approximate range of the original data of 1 for the original data, which is the absolute coordinate data before adding the adjustment value. The approximate position processing module 102G performs processing to add the same adjustment value for the needle positions of the original data as that added to the other original data determined to be approximate.

One of the approximate needle positions may have the same coordinates as the other needle position, and the same adjustment value may be added to the needle position that has the same coordinates as the other (tie position processing).

If an adjustment value is added to the previous needle position, and then another original data that should be the same position is detected by approximate position detection, which is performed by comparing the source data before the adjustment value is added, the coordinates to which the adjustment value has already been added may be copied and used as the coordinates of the other needle position.

The combination pattern generation module 102H temporarily stores hand-drawn-effect processed data for said one pattern in the working memory (RAM) 103.

The combination pattern generation module 102H displays said one pattern which was converted to a hand-drawn-effect on the "preview screen" of the operation screen displayed on the liquid crystal display 105 shown in FIG. 3 via the display controller 104.

The combination pattern generation module 102H creates a combination pattern by fine-adjusting the stitch data 102K using new random numbers when the same pattern is selected again by the user.

The combination pattern edit module 102I deletes or adds patterns and changes combinations.

In addition, the combination pattern edit module 102I performs fine-adjusting of the pattern by using new random numbers when a pattern is added.

The save/read module 102J writes the combined pattern data to the external medium 109, etc.

The save/read module 102J also reads the combined pattern data from the external medium 109, etc.

RAM 103 temporarily stores various functional modules loaded from ROM 102. The various functional modules are, for example, the operating system and basic libraries, etc.

RAM 103 also temporarily stores and saves data to be used for work in the central processing unit (CPU) 101.

The display controller 104 executes control of display data to be displayed on the liquid crystal display 105, which is described below.

The liquid crystal display 105 displays, for example, an operational screen such as that illustrated in FIG. 3.

The liquid crystal display 105 is electrically connected to the central processing unit (CPU) 101 through the external input/output unit.

The touch panel 106, described below, has a multilayer structure superimposed at the lower side of a display face of the liquid crystal display 105, with the touch panel 106 and the liquid crystal display 105 being unitized into a "display section".

Patterns and text, buttons, and the like are displayed on the liquid crystal display 105.

The touch panel 106 is configured by an electrostatic capacitance type of panel, a resistance film type of panel, or the like, and is electrically connected to the central processing unit (CPU) 101 through the external input/output unit.

In consideration of the convenience of user operation, the touch panel 106 is disposed with exposing operably at an external portion of the coordinate data generator 10.

The user is able to operate the touch panel 106 by finger touch while confirming hand-drawn-effect mode selection, pattern selection, and the like on the screen.

The tact switch 107 transmits instructions to the central processing unit 101 to start and stop sewing, raise and lower the needle, threading (not shown), etc., when pressed by the user.

The universal serial bus (USB) controller 108 connects the coordinate data generator 10 to external devices such as the external medium 109 and controls the connection thereto.

The external medium 109 is, for example, a hard disk, a DVD recorder, or the like, and pattern data and the like is written to, and saved on, the external medium 109 under control of the USB controller 108.

The sewing machine motor controller 110 drives and controls the sewing machine motor 110A based on commands from the central processing unit (CPU) 101 to control the processing of moving the needle bar up and down and forming seams with the sewing needle, upper thread and lower thread.

The amplitude and feed motor controller 111 drives and controls the amplitude motor 111A and feed motor 111B to control the behavior of the needle bar of the sewing mechanism, the amount of cloth fed by the feed dog, and the switching back and forth.

The amplitude and feed motor controller 111 then controls the needle position and the amount of cloth feed to change the stitch position and create a stitch to form a pattern.

The central processing unit (CPU) 101 sequentially executes program modules stored on the ROM 102 so as to, for example, convert ordinary sewing data into hand-drawn-effect stitch data.

For example, central processing unit (CPU) 101 creates a hand-drawn-effect for a sewing pattern by moving each needle position of the ordinary sewing stitch data by fine distances in the X direction and the Y direction, and by performing fine adjustments of different lengths and direction on all of the needle positions.

More specifically, the central processing unit (CPU) 101 generates a coordinate array of needle positions in a sewing image from the stitch data 102K.

Then, the central processing unit (CPU) 101 generates random numbers to generate fine length adjustment values (±1.0 mm) and adds that lengths to the coordinates of each needle position in the X and Y directions.

Furthermore, when there is a needle position of other original data within the approximate range of the needle position of the original data, which is the absolute coordinate data before adding the adjustment value, the central processing unit (CPU) 101 performs processing to add the same adjustment value as that added to the other original data via the approximate position processing module 102G and to create a combination pattern using the stitch data 102K converted to a hand-drawn-effect.

The approximate range refers to here, a predefined range that is not the same position. For example, a range greater than 0 (zero) and less than ±0.2 mm can be used as an example.

The user may change the approximate range as needed.

The details of the processing are described further below.

Coordinate Data Generator Processing

Figure 2:
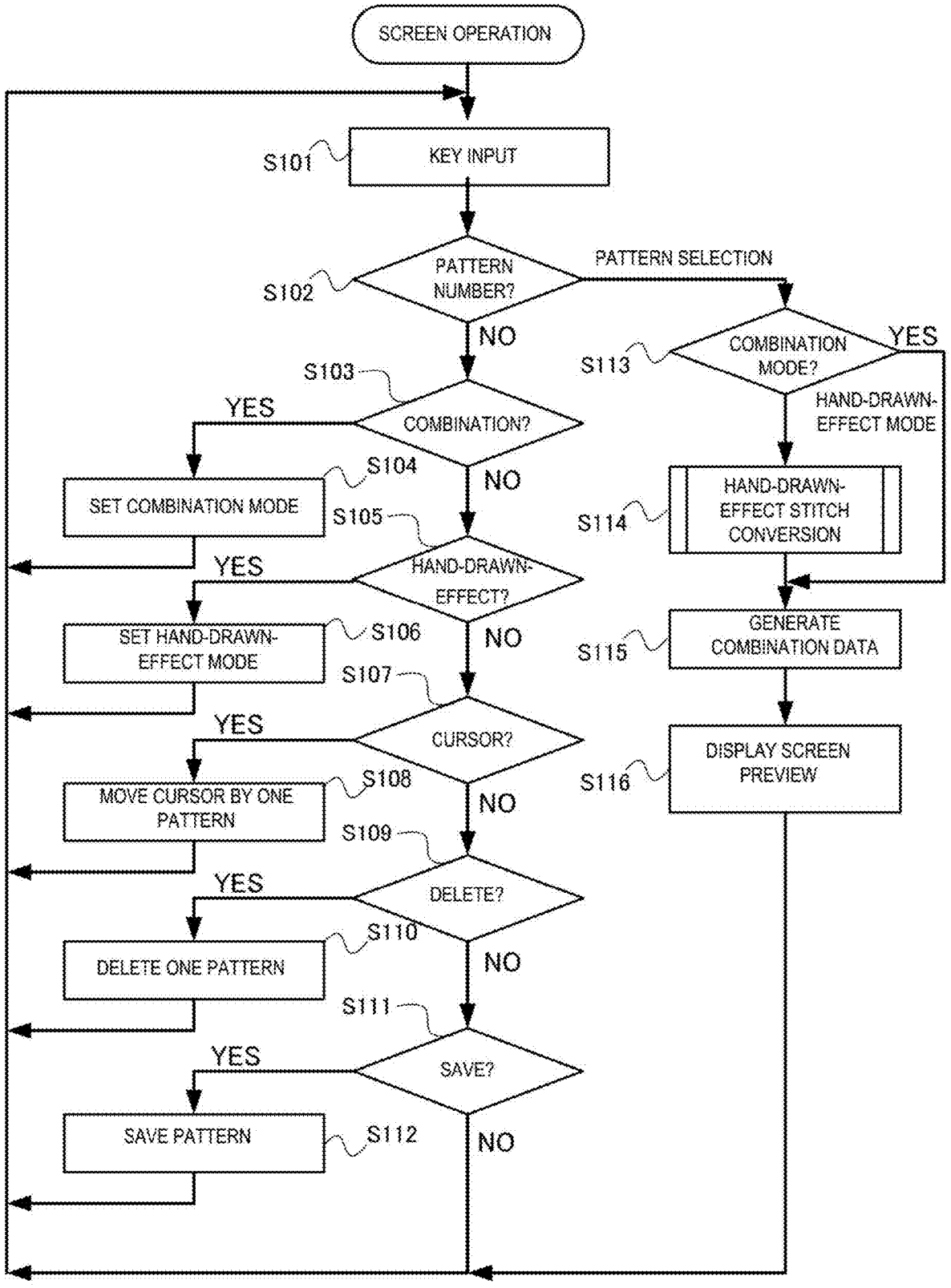
FIG. 2 is a flowchart of processing during screen operation in the a coordinate data generator according to the embodiment of the present invention.
Figure 4:
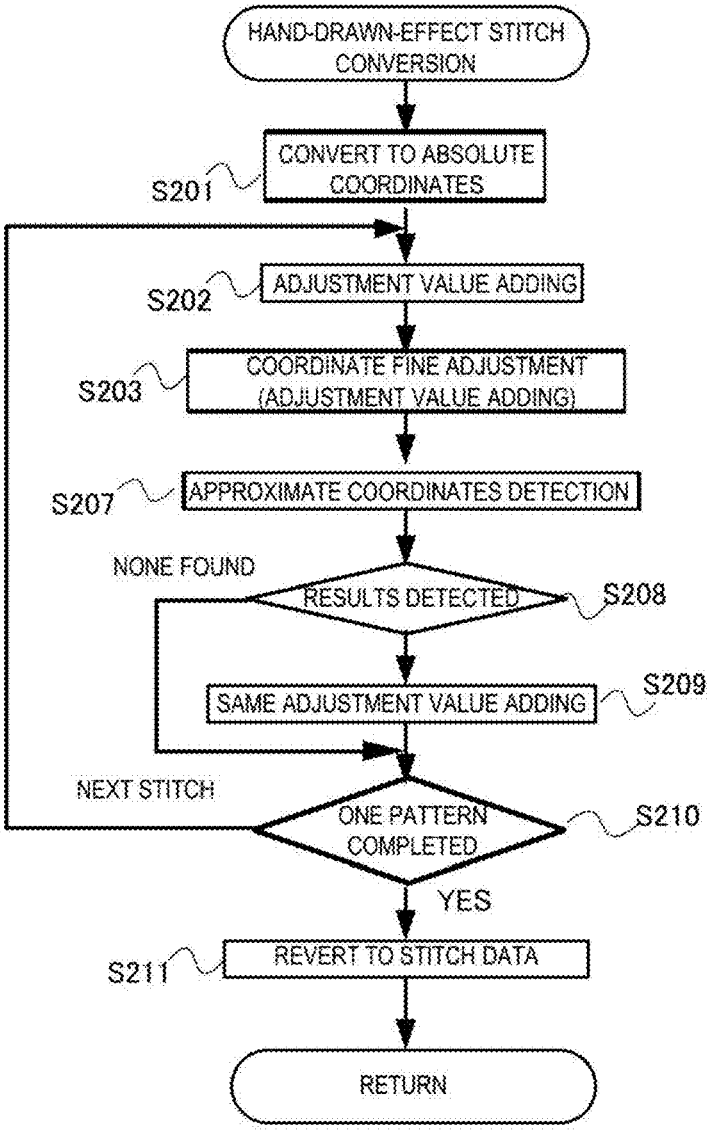
FIG. 4 is a flowchart of processing related to hand-drawn-effect stitch conversion in the coordinate data generator according to the embodiment of the present invention.

A description follows regarding details of screen operation processing and hand-drawn-effect stitch conversion processing in the coordinate data generator 10 according to the present embodiment, with reference to FIG. 2 to FIG. 4.

Screen Operation Processing

The generation of sewing data using the coordinate data generator 10 according to the present embodiment is performed by operating on a screen displayed on the liquid crystal display 105 such as that illustrated in FIG. 3.

Screen operation processing for the coordinate data generator 10 according to the present embodiment will be described, with reference to FIG. 2, before describing details regarding the processing of the coordinate data generator 10.

When a display mode to display an operation screen such as that illustrated in FIG. 3 on the liquid crystal display 105 is selected by a user, first the central processing unit (CPU) 101 of the coordinate data generator 10 transitions to a standby mode awaiting pressing of an operation button, a cursor button, a pattern button, or the like by key input by the user (step S101).

Next, the central processing unit (CPU) 101 determines whether a pattern has been selected by the user (step S102).

When the determination result by the central processing unit (CPU) 101 is that the user has selected a pattern, namely, when determined that the user has input a pattern number or the like ("pattern selection" in step S102), a determination is then made as whether this selection is to be subjected to combination mode processing or hand-drawn-effect mode processing (step S113).

Note that processing is performed and patterns are stored in the selected sequence for both combination mode processing and hand-drawn-effect mode processing.

Returning to step S102, when the determination result by the central processing unit (CPU) 101 is that a pattern has not been selected by the user, namely, when determined that a pattern number or the like has not been input by the user (step S102="No"), then the combination mode is set if the combination button has been pressed (step S103="Yes"), and processing returns to step S101 (step S104).

When the central processing unit (CPU) 101 has determined at step S103 that the user has not pressed the combination button (step S103="No"), then determination is made as to whether the user has pressed the hand-drawn-effect button (step S105).

When the central processing unit (CPU) 101 has determined at step S105 that the user has pressed the hand-drawn-effect button (step S105="Yes"), then the hand-drawn-effect mode is set (step S106), and processing then returns to step S101.

When the central processing unit (CPU) 101 has determined at step S105 that the user has not pressed the hand-drawn-effect button (step S105="No"), then determination is made as to whether the user has pressed the cursor button (step S107).

When the central processing unit (CPU) 101 has determined at step S107 that the user has pressed the cursor button (step S107="Yes"), then the cursor is advanced or retreated along a pattern array stored in ROM 102 (step S108), and processing then returns to step S101.

When the central processing unit (CPU) 101 has determined at step S107 that the user has not pressed the cursor button (step S107="No"), then determination is made as to whether the user has pressed a delete button (step S109).

When the central processing unit (CPU) 101 has determined at step S109 that the user has pressed the delete button (step S109="Yes"), then the pattern at the displayed position of the cursor is deleted and subsequent patterns are promoted toward the start of the array (step S110), and processing then returns to step S101.

When the central processing unit (CPU) 101 has determined at step S109 that the user has not pressed the delete button (step S109="No"), then determination is made as to whether the user has pressed a save button (step S111).

When the central processing unit (CPU) 101 has determined at step S111 that the user has pressed the save button (step S111="Yes"), then the pattern converted by the hand-drawn-effect and the combination pattern are saved on an external medium 109 or the like so as to enable subsequent re-utilization, and processing returns to step S101 (step S112).

When the central processing unit (CPU) 101 has determined at step S111 that the user has not pressed the save button (step S111="No"), then processing returns to step S101.

When the central processing unit (CPU) 101 has determined at step S113 that the user has pressed a pattern button in hand-drawn-effect mode (step S113), then a hand-drawn-effect stitch conversion processing routine is called (step S114).

Details regarding the hand-drawn-effect stitch conversion processing are described further below.

When the central processing unit (CPU) 101 has determined at step S113 that the user has pressed the combination mode button (step S113="Yes") or the hand-drawn-effect stitch conversion processing of step S114 has been completed, then the pattern data is combined (step S115) similarly to in ordinary pattern combination.

At step S116 the central processing unit (CPU) 101 then displays a preview screen on the liquid crystal display 105.

This thereby enables the user to confirm the converted state.

Note that handling the pattern converted by the hand-drawn-effect mode in the same manner to an ordinary pattern enables editing operations such as deletion and addition to be performed.

Hand-Drawn-Effect Stitch Conversion Processing

Details regarding the hand-drawn-effect stitch conversion processing will be described with reference to FIG. 4.

The following is an overview of the "fluctuation addition processing (addition of adjustment values)" and the "approximate position (approximate coordinates detection) processing" as a hand-drawn-effect stitch conversion processing.

As for the order of processing, it is preferable to perform "approximate coordinate detection" followed by "fluctuation addition processing," but "fluctuation addition processing" may be performed first.

Approximate Position (Approximate Coordinates) Processing

Depending on the pattern shape, there may be stitch data 102K to be formed through approximate positions.

In this case, if all needle positions are shifted without limit by random number adjustment values (fluctuations), the original pattern shape may be lost.

Therefore, in the approximate position (approximate coordinates) processing in the embodiment, when the distance between the coordinate data of the needle position of 1 stored in the coordinate data storage (ROM 102) and the coordinate data of the other needle position is greater than 0 (zero) and less than a predetermined distance, the control is performed so that the respective independent values to be added to the X coordinate value or Y coordinate value of the coordinate data of the needle position of 1 are identical to the independent values to be added to the X coordinate value or Y coordinate value of the coordinate data of the other needle position.

"Predetermined distance" is a predetermined distance or a distance set by the user, etc. The approximate position (approximate coordinates) refers to the needle position of the approximate range described above.

In the present invention, the range below the predetermined distance is considered to be the approximate range, and the above processing is performed.

Hand-Drawn-Effect Stitch Conversion Processing Details

In order to execute such processing, the user presses the "hand-drawn-effect" button on the operation screen being displayed on the liquid crystal display 105, such as that illustrated in FIG. 3, to set the hand-drawn-effect combination mode.

The user then presses the pattern selection button to select a pattern.

First, the central processing unit (CPU) 101 of the coordinate data generator 10 converts the stitch data 102K of the pattern selected by the user that is stated in relative movement amounts for the feed direction, into an absolute coordinate data array by performing cumulative processing on these relative feed amounts (step S201).

The central processing unit (CPU) 101 acquires two random numbers to be employed respectively for amplitude and for feeding.

Due to random numbers obtained at this point being integers, the integer random numbers are then converted into adjustment values within a range of ±1.0 mm (step S202).

The central processing unit (CPU) 101 performs fine adjustment by adding the adjustment values converted at step S202 to the coordinates in the amplitude direction and the feed direction (step S203).

The central processing unit (CPU) 101 detects the presence or absence of needle positions in the approximate range (step S207).

Specifically, in the original data, which is the absolute coordinate data before the adjustment values are added, the needle positions that are within an approximate range are searched.

For example, the needle positions with coordinates that are within a range predetermined by the user, etc., such as a distance of around 2 mm from the coordinates of the first stitch, is searched until the end of stitching.

If the central processing unit (CPU) 101 detects one or more original data of other needle position in the approximate range to the original data of the needle position of 1 as a result of the search (step S208), it executes the processing of adding the adjustment value to be added to the original data of the needle position of 1 to the original data of the other needle position (step S209).

However, the central processing unit (CPU) 101 cannot make fine adjustments beyond the limits of the mechanism. A spacing between the X coordinate value of the coordinate data after fine adjustment of a certain needle position and the X coordinate value of the coordinate data after fine adjustment of adjacent needle positions in the sewing sequence must be within the limits of the feed mechanism.

For the amplitude, the value of the Y-coordinate after fine adjustment is within the limit of the amplitude mechanism (e.g., −4.4 mm or +4.4 mm).

If the value of the Y coordinate of the fine-adjusted coordinate exceeds the limit of the mechanism in the amplitude (Y coordinate) direction or the spacing between the X coordinate value of the fine-adjusted coordinate data and the X coordinate value of the adjacent fine-adjusted coordinate data in the sewing sequence exceeds the limit of the mechanism in the feed (X coordinate) direction, the fine-adjusting processing in step S203 and step 209 are cancelled.

It is also possible to perform separate fine-adjusting processing within the range that does not exceed the mechanism limit, for example, to fine-adjust the coordinates newly by generating and adding adjustment values again, or to fine-adjust up to the mechanism limit. In any fine adjustment processing, including invalid fine adjustment, if there is a needle position in the original data that is within the approximate range, the adjustment value added to the original data for that needle position is the same.

The value of the limit for the mechanism in the amplitude direction, for example, −4.4 mm or +4.4 mm, and the value of the limit for the mechanism in the feed direction, for example, −5.0 mm or +5.0 mm of relative movement can be used as examples.

The above is related to the limit in ordinary sewing, but in embroidery sewing, if the value of the coordinate data after fine adjustment exceeds the limit in the X or Y coordinate direction of the embroidery frame, the fine adjustment processing is cancelled as described above, or the adjustment value is generated again and fine adjustment processing is performed, etc.

If the central processing unit (CPU) 101 does not detect any approximate coordinates as a result of the search (step S208), it moves the processing to step S210.

When determined that said one pattern has been completed (step S210), the central processing unit (CPU) 101 converts the feed data that is now in absolute coordinates due to the fine adjustment processing into relative movement amounts so as to be reverted to the format of stitch data 102K (step S211).

Since the fine-adjusting processing has resulted in absolute coordinates, the central processing unit (CPU) 101 converts the feed data into relative movement amounts so as to be reverted to the format of stitch data 102K.

In the case that the central processing unit (CPU) 101 determines said one pattern of stitching has not been completed (step S210), the processing returns to step S202.

Example 1

Description follows regarding an Example 1 of the present invention, with reference to FIG. 5 to FIG. 9.

When creating stitch data, depending on the shape of the design, the approximate positions may be passed through multiple times to make the stitches appear multiple or thicker.

Figure 5:
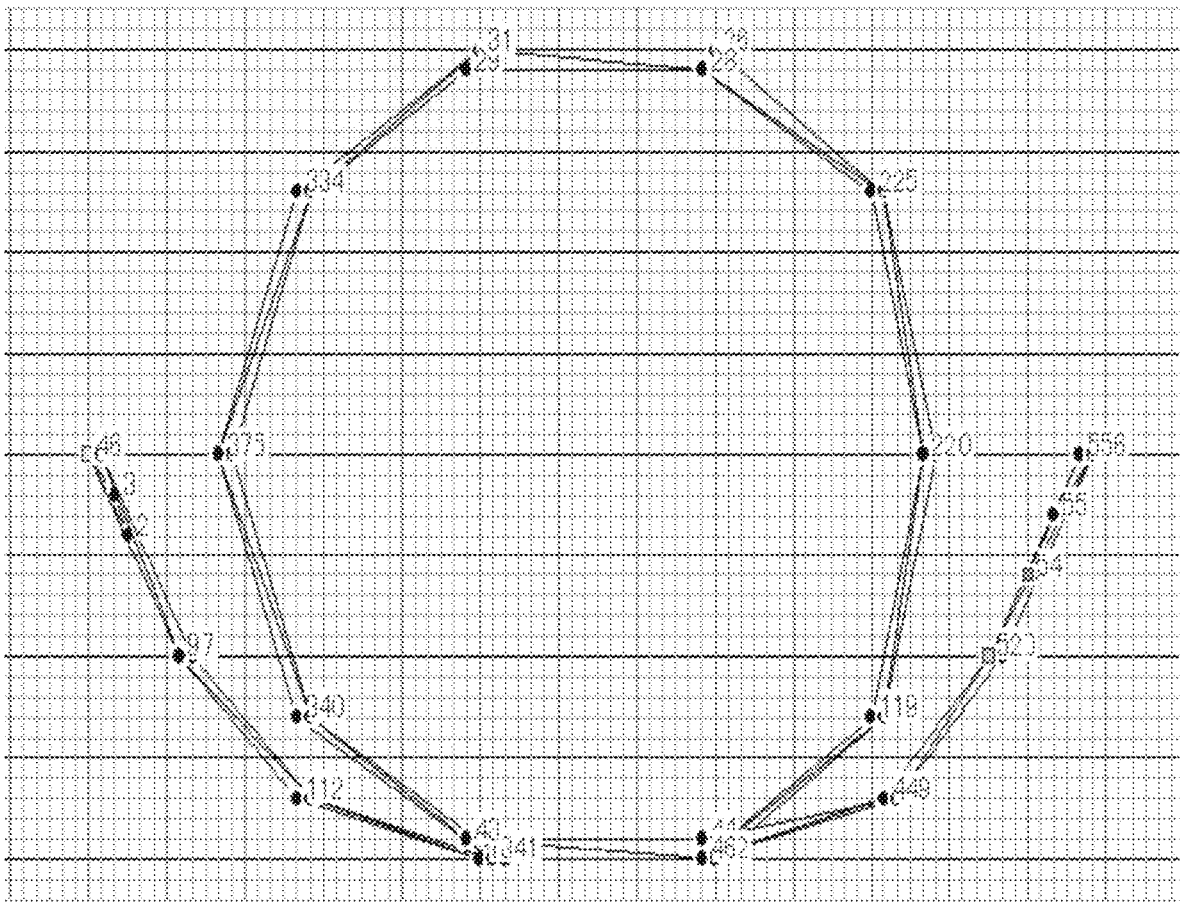
FIG. 5 is a drawing illustrating an original sewing image for Example 1 of the present invention.

In the case of the pattern in FIG. 5, the original stitch data 102K would have three needle positions at the approximate positions by sewing three times within a certain range.

Figure 6:
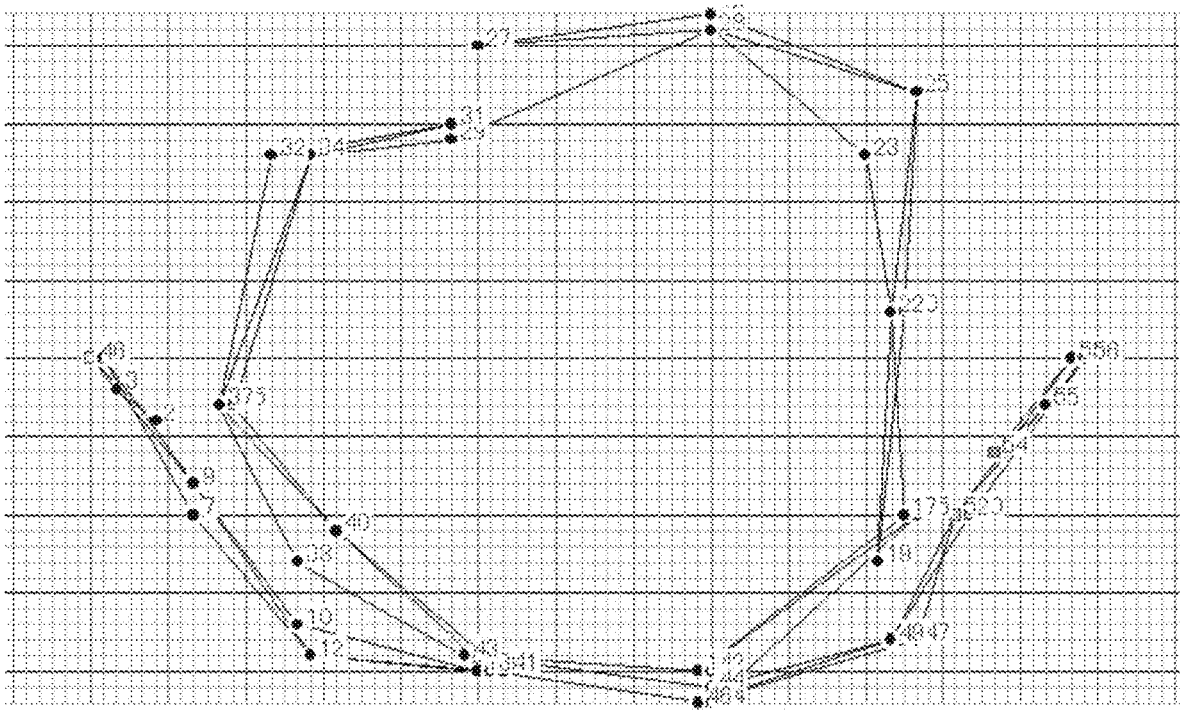
FIG. 6 is a drawing illustrating a sewing image based on a converted data without approximate position processing for the original sewing image for Example 1 of the present invention.

If this pattern is given a moderate variation for each stitch, the pattern will be as shown in FIG. 6.

The pattern in FIG. 6 is an example of a pattern in which a part that was originally intended to appear as a thick line is divided into multiple lines due to fluctuations.

Therefore, the stitches that have been determined to be approximate positions in advance are controlled to fluctuate so that the same spacings are provided for the stitching in the converted stitches.

This makes it possible to generate a pattern with fluctuation processing while maintaining the thickness of the lines in the original pattern.

The pattern of one cycle can be represented by a data array of absolute coordinates as shown in the list "amplitude and absolute feed of original data" in FIG. 9 by accumulating the feed data of relative distances.

A search of this data array for an approximate position reveals that the 21st stitch in "original data" exists at amplitude "−2.6" and absolute feed "10.2".

A search for needle positions where the amplitude and absolute feed are at approximate positions (e.g., within ±0.2 mm) reveals that the 23rd stitch (amplitude "−2.6", absolute feed "10.0") and the 25th stitch (amplitude "−2.6", absolute feed "10.2") are approximate positions.

Similarly, for the 24th stitch, the 26th and 28th stitches are approximate positions, and for the 27th stitch, the 29th and 31st stitches are approximate positions, indicating that the second and third stitches are formed.

Adjustment values are then derived using random numbers, with an example thereof listed as "random number adjustment lengths for amplitude, for feed"

These adjustment values are added to the "original data amplitude and absolute feed" to perform hand-drawn processing.

However, in cases in which the sewing mechanism limit would be exceeded, the addition is cancelled and not performed.

The adjusted amplitudes and absolute feeds are then recorded for each stitch, as in the example of "hand-drawn processing amplitude and absolute feed", and when there are stitches present that are at the approximate position as each other in the "original data", one or other of the adjusted values is employed for both stitches, this being processing so that the coordinate spacing is maintained even after adjustment.

In the example of FIG. 9, the 21st stitch and the 23rd and 25th stitches are approximate needle positions, so that the coordinates after adjustment are also approximate, for example, the adjustment value (random number adjustment length) for the 21st stitch is applied to the 23rd and 25th stitches.

Similar processing is also performed for the 24th and 26th and 28th stitches, and the 27th and 29th and 31st stitches, the processing of applying the adjusted value (random number adjustment length) of the 24th stitch to the 26th and 28th stitches and the adjusted value (random number adjustment length) of the 27th stitch to the 29th and 31st stitches is executed so that the coordinates after adjustment are approximate positions.

Figure 8:
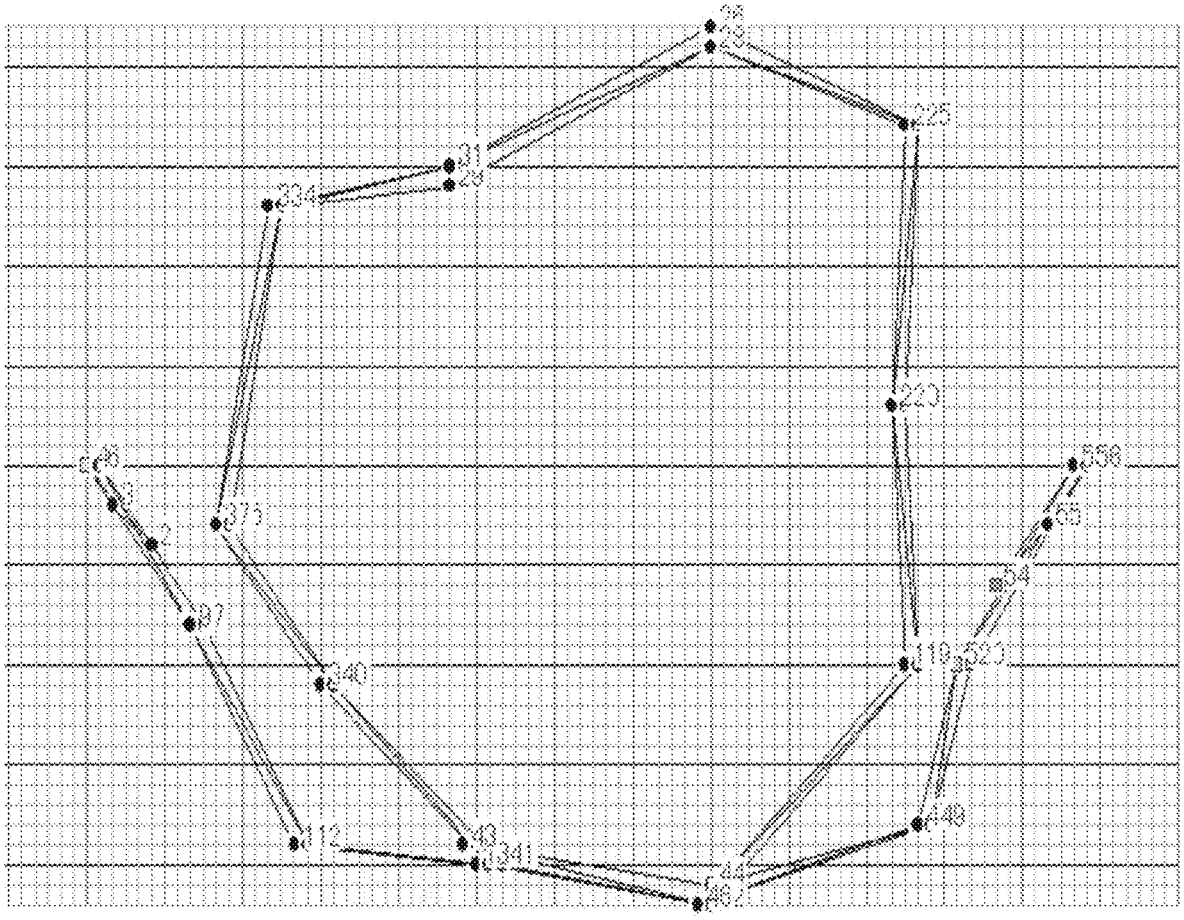
FIG. 8 is a drawing illustrating a sewing image with converted data when approximate position processing is performed on the original sewing image for Example 1 of the present invention.

Such processing enables the shape deformation to be performed with a hand-drawn-effect as shown in FIG. 8, while maintaining the shape of the original pattern shown in the original FIG. 5.

In Example 1, the same adjustment values are added to multiple needle positions in the approximate range, giving fluctuation to the part of the line that is to appear thicker, while maintaining its thickness.

It is also possible to perform the tie position processing for multiple needle positions within the approximate range, combining them into a single position and giving it a fluctuation.

Figure 7:
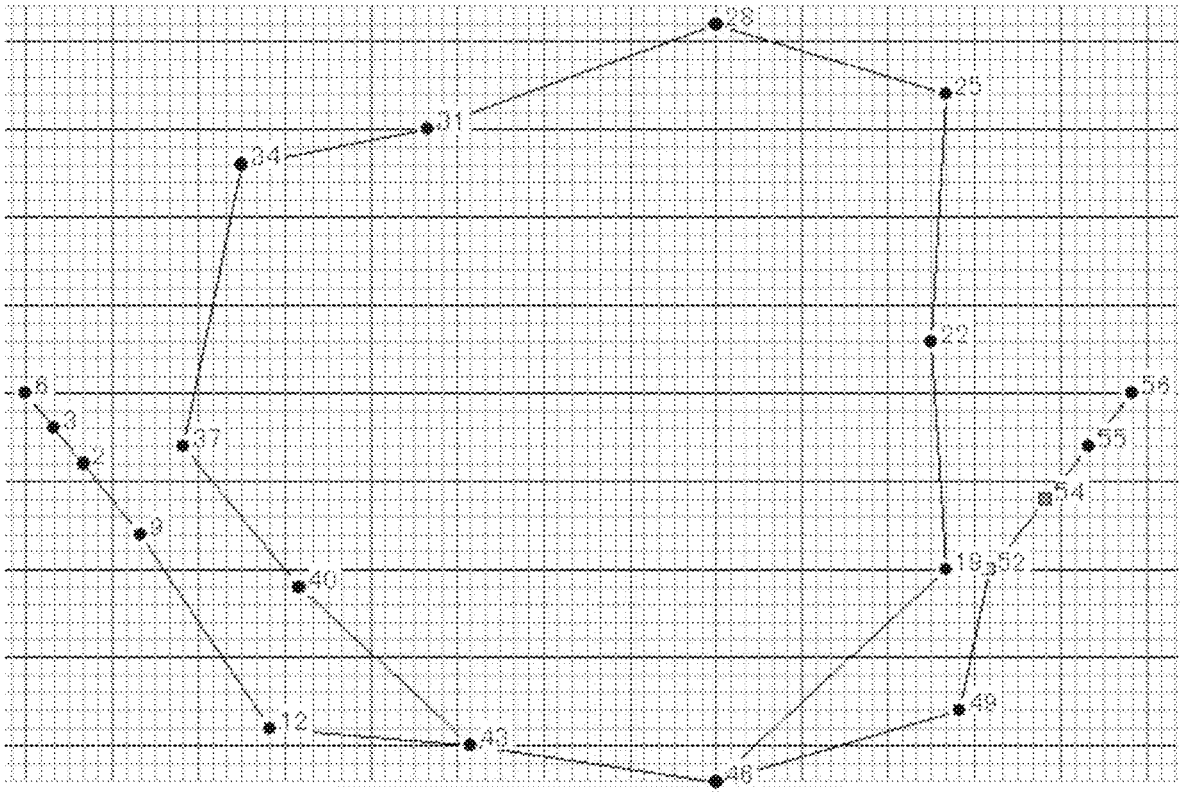
FIG. 7 is a drawing illustrating a sewing image based on the converted data when tie position processing is performed on the original sewing image for Example 1 of the present invention.

FIG. 7 shows the triple lines shown in FIG. 5, grouped together as one line and given fluctuation.

Advantageous Effects of Invention

As explained above, according to this embodiment and this example, the sewing machine coordinate data generator 10 to generate coordinate data of absolute positions configured by the X coordinate values and the Y coordinate values of the needle positions for the pattern to be sewn comprises:

- a coordinate data storage (ROM 102) to store the coordinate data of the needle positions; and
- a post-addition coordinate data generation section (adjustment value adding module 102E) to add respective independent values to the X coordinate value or the Y coordinate value of the coordinate data for each item of the coordinate data stored in the coordinate data storage (ROM 102), so as to generate new coordinate data.

The post-addition coordinate data generation section (adjustment value adding module 102E), when the distance between the coordinate data of the needle position of 1 stored in the coordinate data storage (ROM 102) and the coordinate data of the other needle position is greater than 0 (zero) and less than a predetermined distance, makes the respective independent values to be added to the X coordinate value or Y coordinate value of the coordinate data of the needle position of 1 the same values for the respective independent values to be added to the X coordinate value or Y coordinate value of the coordinate data of the other needle position.

"Predetermined distance" here, is a distance within a predetermined range or a distance set by the user, etc.

For example, a value greater than 0 (zero) and less than ±0.2 mm can be used as an example. "The respective independent values to be added" refers to the random number adjustment lengths or random number adjustment values for amplitude and feed generated for each needle number.

In other words, when the distance between the coordinate data of the needle position of 1 and the coordinate data of the other needle position is greater than 0 (zero) and less than or equal to a predetermined distance, respective independent values to be added to the X-coordinate value or Y-coordinate value of the coordinate data of the needle position of 1 is the same as the respective independent values to be added to the X-coordinate value or Y-coordinate value of the coordinate data of the other needle position.

Therefore, it enables seams to be generated that bring out a hand-drawn-effect in a sewing pattern, and give a warm fuzzy feeling without significantly damaging the shape of the original pattern.

Note that coordinate data referred to here encompasses coordinate data for both ordinary sewing or embroidery sewing.

The processing to add respective independent values to the X coordinate value or the Y coordinate value in the coordinate data is processing in which respective independent values are added to X coordinate values and Y coordinate values in the coordinate data. In consideration that the respective independent values might be zero, for example, then this processing also encompasses adding such respective independent values to either the X coordinate value or the Y coordinate value of the coordinate data.

The coordinate data generator 10 comprises a setting unit that sets a predetermined distance.

The level at which the original pattern shape is not significantly damaged varies depending on the sensitivity of each user.

The coordinate data generator 10 of this embodiment comprises the setting unit that allows the user to set a predetermined distance.

Thus, for example, the user can set the predetermined distance with the setting unit and display the image after the setting on the liquid crystal display 105 to set the predetermined distance according to his/her own sensitivity.

Note that the processing of the coordinate data generator 10 may be recorded on a recording medium readable by a computer or a computer system, with the program recorded on the recording medium then read into the coordinate data generator 10, and the coordinate data generator 10 of the present invention realized by then executing this processing. The computer system or computer referred to here encompasses an OS as well as hardware such as peripheral devices and the like.

"Computer system or computer" also encompass a home page provision environment (or display environment) for cases utilizing a world wide web (www) system.

The program referred to above may also be transmitted from one computer system or computer where the program is stored on a storage device or the like to another computer system or computer via a transfer medium, or via transmission waves through a transfer medium.

Reference here to a "transfer medium" to transfer the program encompasses a network (communication network) such as the Internet, and a medium including a function for transferring information such a communications line (coms line) like a telephone line or the like.

The program referred to above may be a program that implements part of the functions described above. Furthermore, the functions described above may be implemented in combination with a program already recorded on a computer system or computer, in what is referred to as an incremental file (incremental program).

Although detailed explanation has been given of embodiments of the present invention with reference to the drawings, specific configurations are not limited to these embodiments, and encompass any designs or the like not departing from the range of the spirit of the invention.

For example, the coordinate data generator 10 may be a separate device such as a personal computer, or may be device built into a sewing machine or the like.

EXPLANATION OF THE REFERENCE NUMERALS

10 coordinate data generator
101 central processing unit (CPU)
102 ROM
102A hand-drawn-effect mode selection module
102B pattern selection module
102C absolute feed format conversion module
102D adjustment value generation module
102E adjustment value adding module
102F sewing mechanism limit restriction module
102G approximate position processing module
102H combination pattern generation module
102I combination pattern edit module
102J save/read module
103 working memory (RAM)
104 display controller
105 liquid crystal display
106 touch panel
107 tact switch
108 USB controller
109 external medium
110 sewing machine motor controller
110A sewing machine motor
111 amplitude and feed motor controller
111A amplitude motor
111B feed motor

The invention claimed is:

1. A sewing machine coordinate data generator to generate coordinate data of absolute positions configured by X coordinate values and Y coordinate values of needle positions for a pattern to be sewn comprising;

a coordinate data storage section for storing the coordinate data of the needle positions;

a distance setting section to allows a user to set a predetermined distance; and a post-addition coordinate data generation section to add respective independent values to the X coordinate values or the Y coordinate values of the coordinate data for each item of the coordinate data stored in the coordinate data storage, so as to generate a new coordinate data, wherein:

the post-addition coordinate data generation section, when a distance greater than 0 between the coordinate data of one needle position and the coordinate data of another needle position stored in the coordinate data storage section is less than the predetermined distance, makes the respective independent values to be added to the X coordinate value or Y coordinate value of the coordinate data of the one needle position the same values for the respective independent values to be added to the X coordinate value or Y coordinate value of the coordinate data of the another needle position.

2. The coordinate data generator of claim 1, wherein the post-addition coordinate data generation section makes the coordinate data of the one needle position that is less than the predetermined distance greater than 0 and the coordinate data of the another needle position the same coordinate data.

3. A sewing machine comprising the coordinate data generator of claim 2.

4. A sewing machine comprising the coordinate data generator of claim 1.

5. A non-transitory computer-readable medium storing program to cause a computer to execute a coordinate data generation method that is performed in a sewing machine coordinate data generator comprising a distance setting section, a coordinate data storage to store coordinate data and a post-addition coordinate data generation section, and that generates coordinate data of absolute positions configured by X coordinate values and Y coordinate values of needle positions for a pattern to be sewn, wherein the coordinate data generation method comprises:

by the distance setting section, allowing a user to set a predetermined distance; and by the post-addition coordinate data generation section, when a distance between the coordinate data of one needle position stored in the coordinate data storage unit and the coordinate data of another needle position is equal to or less than the predetermined distance, causing the computer to perform a processing of adding respective independent values to the X coordinate values or the Y coordinate values of the coordinate data of the one needle position to be identical with the respective independent values to the X coordinate values or the Y coordinate values of the coordinate data of the another needle position.

* * * * *